US006708538B1

(12) United States Patent
Walby

(10) Patent No.: US 6,708,538 B1
(45) Date of Patent: Mar. 23, 2004

(54) DOORKNOB LOCK APPARATUS OPERABLE BY COMBINATION OR KEY

(76) Inventor: Curt A. Walby, 3900 Ridge Lea Rd. Apartment D., Amherst, NY (US) 14228

( * ) Notice: Subject to any disclaimer, the term of this patent is extended or adjusted under 35 U.S.C. 154(b) by 0 days.

(21) Appl. No.: 09/694,391

(22) Filed: Oct. 23, 2000

(51) Int. Cl.[7] ..... E05B 37/00

(52) U.S. Cl. ..... 70/285; 70/284; 70/DIG. 71; 70/315

(58) Field of Search ..... 70/285, 284, DIG. 71, 70/312, 314, 315, 318, 306, 308, 309

(56) References Cited

U.S. PATENT DOCUMENTS

| | | | | | |
|---|---|---|---|---|---|
| 1,748,255 | A | * | 2/1930 | Tibbetts | 70/285 |
| 1,909,393 | A | * | 5/1933 | Diesel | 70/445 |
| 1,909,453 | A | * | 5/1933 | Brown | 70/445 |
| 1,937,165 | A | * | 11/1933 | Piagneri | 70/53 |
| 2,002,453 | A | * | 5/1935 | North | 70/53 |
| 2,035,781 | A | * | 3/1936 | Bell | 70/53 |
| 2,047,795 | A | * | 7/1936 | North | 70/29 |
| 2,110,094 | A | * | 3/1938 | Pauloski et al. | 70/284 |
| 2,168,621 | A | * | 8/1939 | Lane et al. | 70/285 |
| 2,251,145 | A | * | 7/1941 | Machinist | 70/319 |
| 2,424,396 | A | * | 7/1947 | Heyer | 70/285 |
| 2,481,099 | A | * | 9/1949 | Formo et al. | 70/285 |
| 3,353,383 | A | | 11/1967 | Fish | 70/151 |
| 3,383,886 | A | * | 5/1968 | Hermann | 70/284 |
| 3,395,557 | A | * | 8/1968 | Berkowitz | 70/285 |
| 3,529,454 | A | | 9/1970 | Fish | 70/278 |
| 3,572,069 | A | * | 3/1971 | Junkunc | 70/285 |
| 3,903,718 | A | | 9/1975 | Fish | 70/156 |
| 3,967,477 | A | * | 7/1976 | Harrington et al. | 70/131 |
| 4,073,518 | A | | 2/1978 | Goodwin | 292/144 |
| 4,104,896 | A | * | 8/1978 | Hahn | 70/310 |
| 4,325,240 | A | * | 4/1982 | Gable | 70/284 |
| 4,901,545 | A | | 2/1990 | Bacon et al. | 70/278 |
| 4,936,122 | A | | 6/1990 | Osada | 70/214 |
| 5,113,675 | A | | 5/1992 | Uyeda | 70/477 |
| 5,475,996 | A | | 12/1995 | Chen | 70/279 |
| 5,794,466 | A | | 8/1998 | Hungerford et al. | 70/63 |

FOREIGN PATENT DOCUMENTS

| | | | | | |
|---|---|---|---|---|---|
| GB | 2 206 642 | A | * | 1/1989 | 70/315 |

* cited by examiner

*Primary Examiner*—John B. Walsh
(74) *Attorney, Agent, or Firm*—Simpson & Simpson, PLLC

(57) ABSTRACT

A lock apparatus operable by combination or key includes a cylinder plug secured at a reference orientation relative to a frame by a plurality of detent wafers biased for engagement with a primary keyway in the frame, and a combination dial mounted coaxially about the cylinder plug and operably connected to the detent wafers by a plurality of cam rings mounted about the frame and cylinder plug for engaging a plurality of associated radial push pins arranged to force the detent wafers out of the primary keyway. The detent wafers are removed from engagement with the keyway by insertion of a key within the cylinder plug or by entry of a combination using the dial to allow rotation of the cylinder plug and an output nut carried thereby away from the cylinder plug's reference orientation. A ratchet-driven cam tube is provided for automatically scrambling the cam rings during operation of the lock apparatus. The combination can be changed by adjusting the relationship between the dial and a first-cam ring driven by the dial. The lock apparatus is suitable for retrofitting with an existing doorknob or deadbolt.

13 Claims, 9 Drawing Sheets

FIG. 11
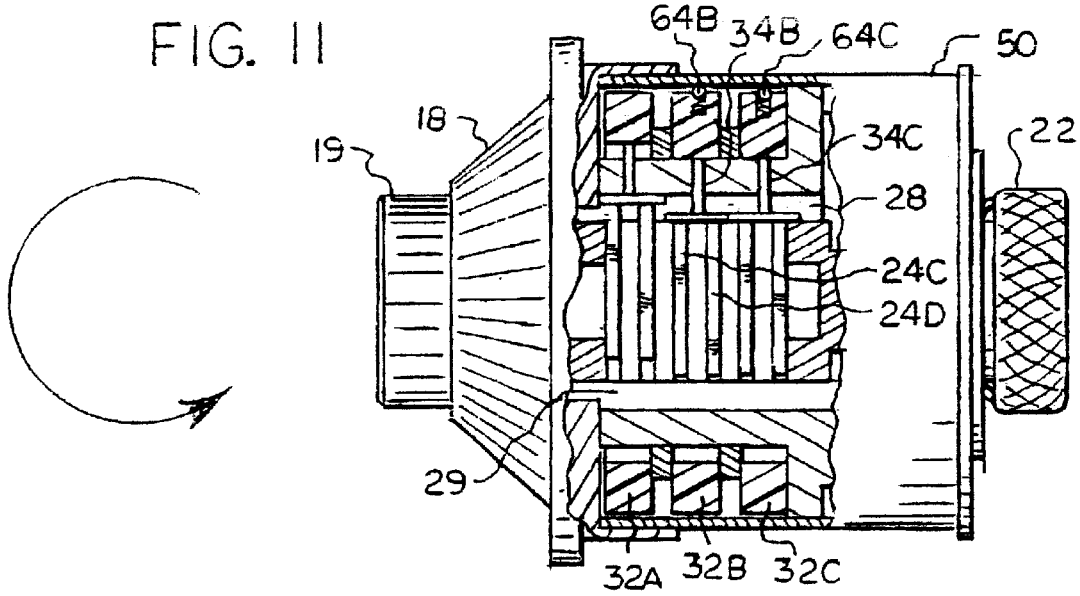
FIG. 12
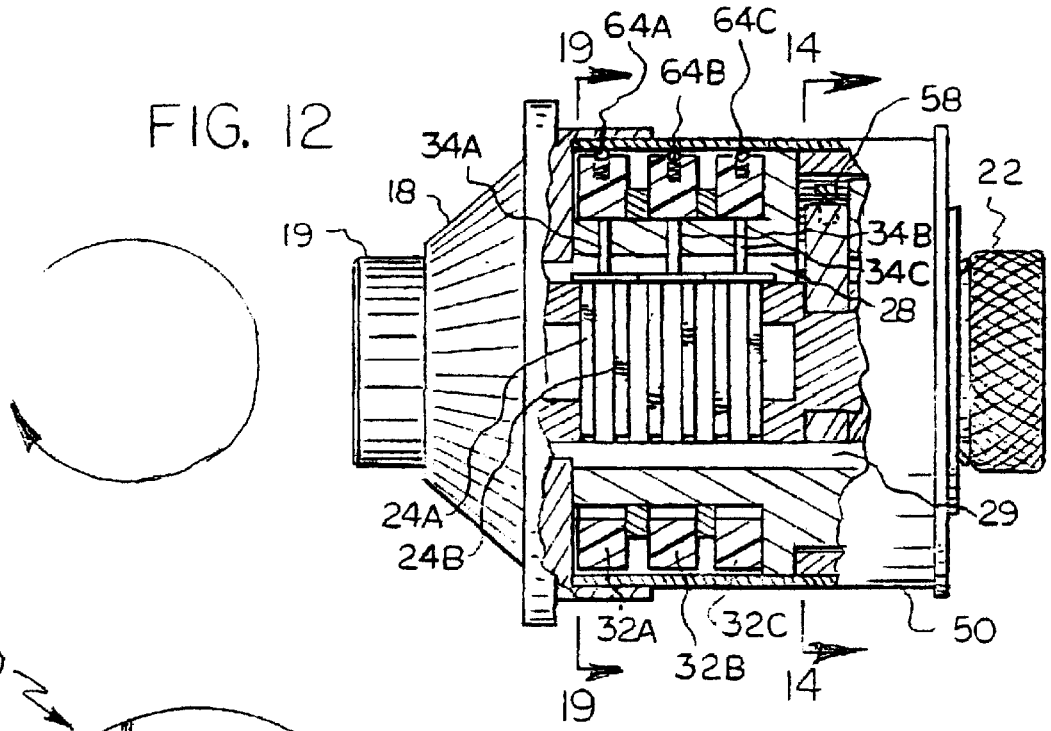
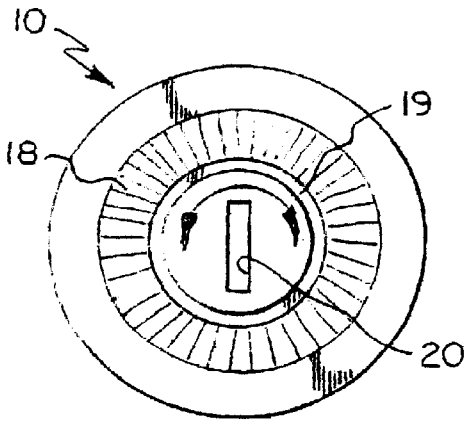
FIG. 13

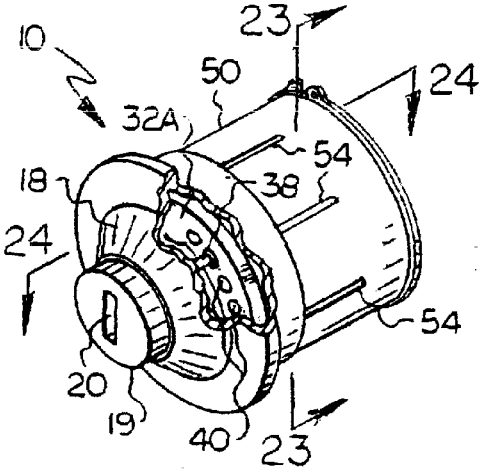
FIG 22
FIG. 23
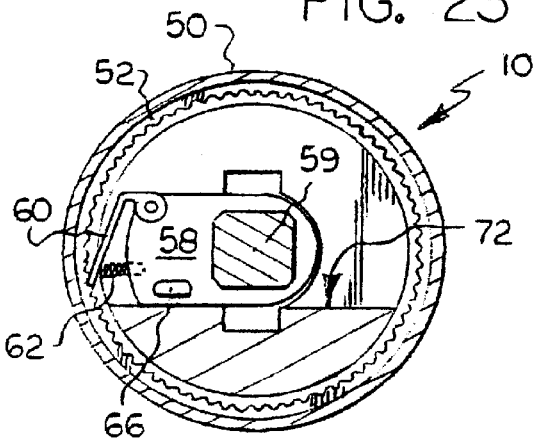
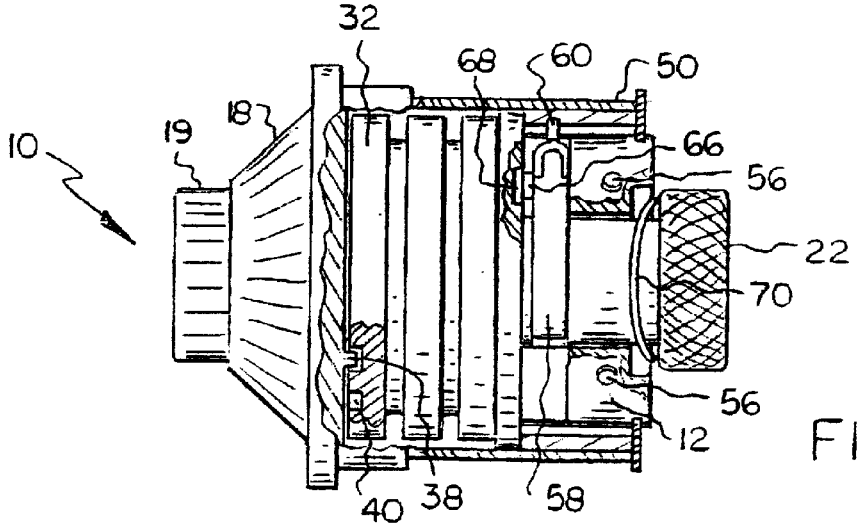
FIG. 24
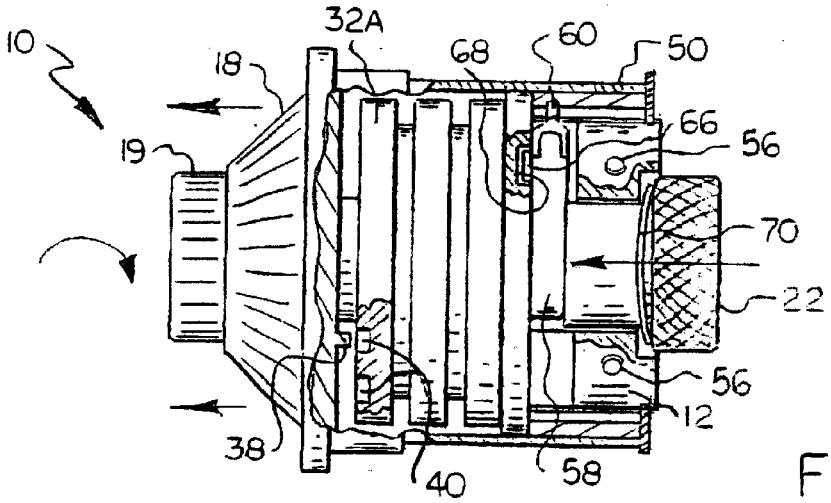
FIG. 25

FIG. 26
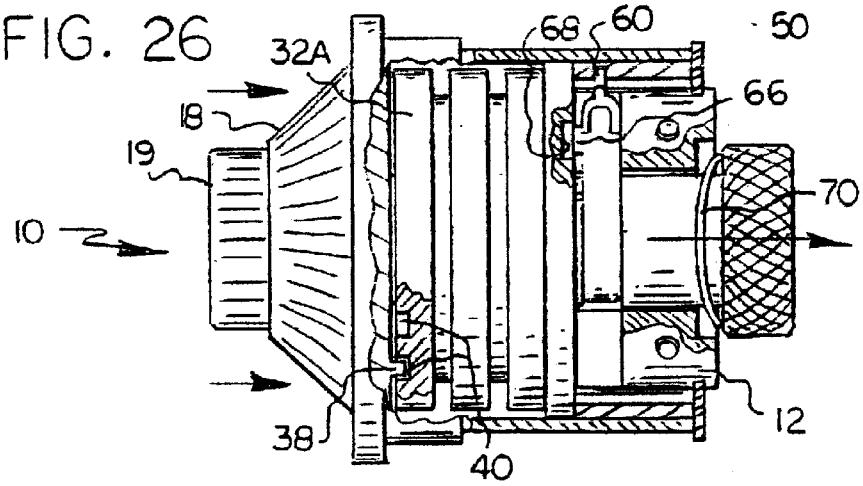
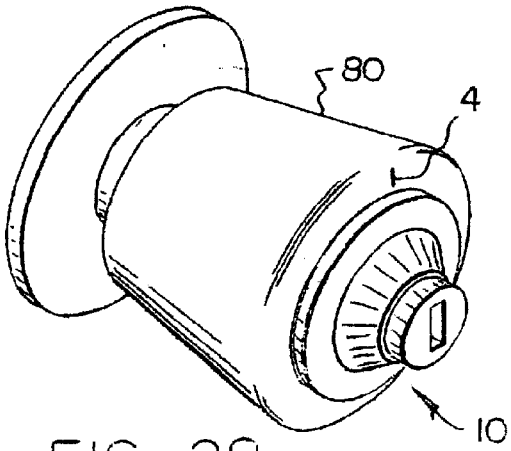
FIG. 28
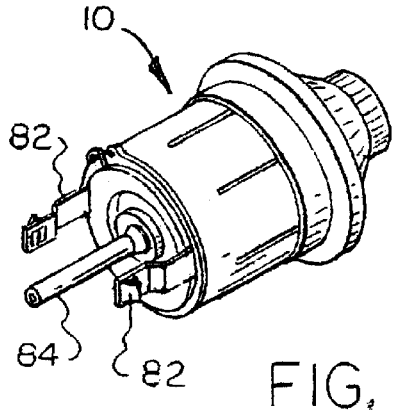
FIG. 27
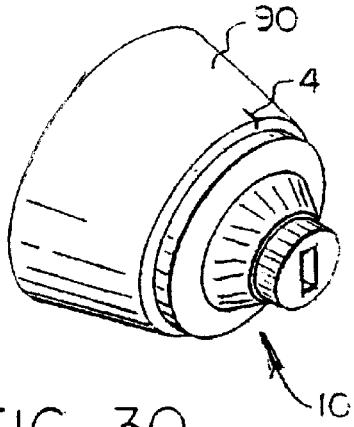
FIG. 30
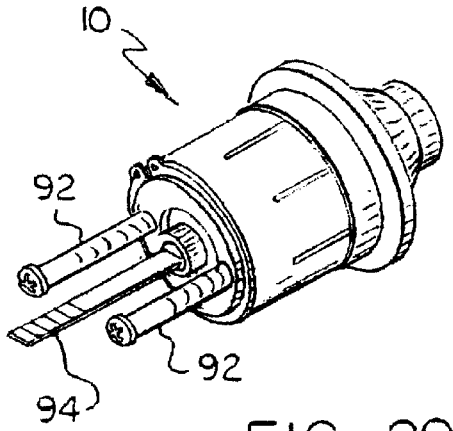
FIG. 29

DOORKNOB LOCK APPARATUS OPERABLE BY COMBINATION OR KEY

BACKGROUND OF THE INVENTION

1. Field of the Invention

The present invention relates to door locking devices, and more particularly to a doorknob lock apparatus that is independently operable by dial entry of a combination or by a key.

2. Description of the Related Art

The need for reliable door locking systems for use at businesses and residences is widely recognized. It is also recognized that a lock capable of operation using a combination or a key offers versatility and convenience over common cylinder locks operable by key only. Consequently, efforts have been made to provide such a lock, as evidenced by prior art U.S. Pat. Nos. 3,353,383; 4,936,122; 5,113,675; and 5,475,996.

While perhaps suitable for specialized applications, the lock mechanisms described in the prior art generally require significant modification or replacement of the existing door and/or lockset. Even in prior art lock mechanisms that are capable of use with an existing lockset, installation is difficult and often requires cutting holes into the door, attaching mounting plates, installing wires, and performing other time consuming and costly steps.

Many electro-mechanical combination/key lock systems of the prior art, for example that of U.S. Pat. No. 4,936,122, require a battery power source having a finite lifetime, such that malfunction occurs when the battery is unable to properly energize the system.

BRIEF SUMMARY OF THE INVENTION

Accordingly, it is a principal object of the present invention to provide an improved convenient lock apparatus employing both key and combination actuating mechanisms by means of which the lock apparatus can be operated either by using a key or by entering the combination.

It is another object of the present invention to provide an improved lock apparatus that fits within the small volume allotted for prior art cylinder lock mechanisms.

It is yet another object of the present invention to provide a combination lock apparatus wherein the combination can be changed quickly and easily without disassembling the lock apparatus.

It is a further object of the present invention to provide a lock apparatus that is retrofittable or adaptable to a doorknob, deadbolt, locker, desk or the like.

It is a further object of the present invention to provide a lock apparatus wherein cam rings for combination operation are automatically scrambled before or as the lock apparatus is re-locked.

It is a further object of the present invention to provide an improved lock apparatus that avoids complicated and costly production and that is easy to assemble.

It is a further object of the present invention to provide a lock apparatus operable by combination or key wherein the combination cannot be determined from a key.

It is a further object of the present invention to provide an improved lock apparatus having an output nut for simple adaptation of the lock apparatus to an existing cylinder lock mechanism.

It is yet a further object of the present invention to accomplish the above objects in a completely mechanical lock apparatus that does not rely upon electrical devices requiring a power source.

In view of these and other objects that will become apparent to the reader, an improved lock apparatus of the present invention generally comprises a frame having an axially extending cylinder bore therethrough, a cylinder plug partially received by the cylinder bore having a keyhole, and a dial mounted coaxially about a front portion of the cylinder plug for combination entry. A front portion of the cylinder plug protrudes from the dial to form a knob, and an output nut is threadably mated with a rear end of the cylinder plug. A plurality of axially spaced detent wafers is slideably held within a plurality of respective radial slots in the cylinder plug, and each detent wafer is spring-biased to engage a primary keyway in the frame to prevent rotation of the cylinder plug relative to the frame. The arrangement defines a predetermined rotational reference orientation of the cylinder plug relative to the frame for maintaining a locked condition. The detent wafers are withdrawn from the primary keyway when a key is inserted in the keyhole, thereby allowing the cylinder plug to be rotated from its reference orientation. The cylinder plug rotation is transmitted through the output nut to move a locking member and achieve an unlocked condition.

The detent wafers are also withdrawn from the primary keyway by entry of a predetermined combination of numbers using the dial. The dial is operably connected to the wafers by a plurality of cam rings arranged about the frame, each cam ring having a cam surface for radially depressing an associated push pin communicating through the frame to one or more detent wafers. The dial rotationally drives a first cam ring adjacent thereto, and the first cam ring serves to drive a next adjacent cam ring, and so on, such that when the combination is entered in the correct manner the cam surface of each cam ring is in depressing engagement with an associated push pin to remove the plurality of detent wafers from the primary keyway.

A cam tube is provided about the cam rings and coupled by way of a ratchet mechanism to the cylinder plug so that the plurality of cam rings is in a scrambled state whenever the lock apparatus is re-locked. In the preferred embodiment, the cam tube includes an internal toothed portion adjacent its rear end, and a plurality of axially elongated slots angularly spaced about cam tube forward of the internal toothed portion. A plurality of spring plungers is mounted at angularly spaced intervals about the frame to engage toothed portion to provide suitable resistance to rotation of the cam tube relative to the frame. A carrier mounted on the cylinder plug supports a ratchet arm such that the carrier and ratchet arm rotate together with the cylinder plug. A free end of the ratchet arm operatively engages the internal toothed portion of the cam tube to rotate the cam tube with the cylinder plug in one rotational direction only. Each cam ring includes a spring plunger arranged to engage one of the plurality of slots in the cam tube upon alignment therewith to cause the cam rings to rotate with the cam tube and cylinder plug to scramble the cam rings either as the cylinder plug is rotated away from its reference orientation during unlocking or back to its reference orientation during relocking.

The lock apparatus preferably allows the combination to be easily changed without the need to disassemble the lock apparatus. Since the combination is determined by the specific driving orientation between the dial and first cam ring as defined by a drive pin coupling these parts, this driving orientation can be adjusted through axially directed separation against a spring bias and relative rotation between the dial and first cam ring to reset the drive pin within a different one of a plurality of angularly spaced drive holes in the coupled part.

The lock apparatus of the present invention is sized for incorporation or retrofit into a doorknob, deadbolt or other lock mechanism. For example, the lock apparatus of the present invention could be used in lockers, desks, or other settings.

BRIEF DESCRIPTION OF THE SEVERAL VIEWS OF THE DRAWINGS

The nature and mode of operation of the present invention will now be more fully described in the following detailed description of the preferred embodiment taken with the accompanying drawing figures, in which:

FIG. 11 is a view similar to that of FIG. 10, however showing operation of a second cam ring of the present invention;

FIG. 12 is a view similar to that of FIG. 11, however showing operation of a first cam ring of the present invention;

FIG. 13 is a front view of the lock apparatus shown in FIG. 1;

FIG. 22 is a perspective view of the lock apparatus partially sectioned to show driving connection between a dial of the present invention and the first cam ring;

FIG. 23 is a cross-sectional view of the lock apparatus taken generally along the line 23—23 in FIG. 22;

FIG. 24 is a cross-sectional view of the lock apparatus taken generally along the line 24—24 in FIG. 22;

FIG. 25 is a view similar to that of FIG. 24 showing axially directed separation of the dial from the first cam ring for changing a combination of the lock apparatus;

FIG. 26 is a view similar to that of FIG. 24 showing axially directed return of the dial into driving connection with the first cam ring after the combination has been changed;

FIG. 27 is a perspective view of a lock apparatus of the present invention adapted for retrofitted installation into a doorknob;

FIG. 28 is a perspective view showing the lock apparatus of FIG. 27 installed in a doorknob;

FIG. 29 is a perspective view of a lock apparatus of the present invention adapted for retrofitted installation into a deadbolt lock; and FIG. 30 is a perspective view showing the lock apparatus of FIG. 29 installed in a deadbolt lock.

DETAILED DESCRIPTION OF THE PREFERRED EMBODIMENTS

Figure 1:
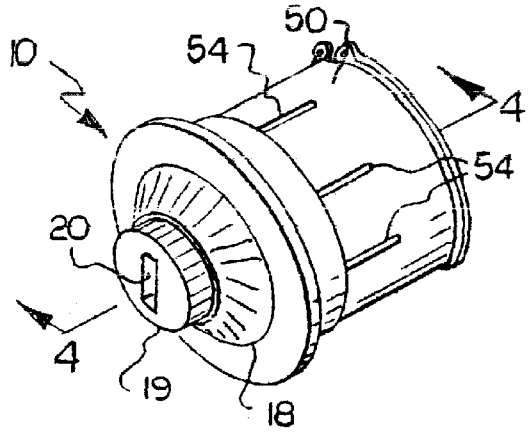
FIG. 1 is a perspective view of a lock apparatus formed in accordance with a preferred embodiment of the present invention.
Figure 2:
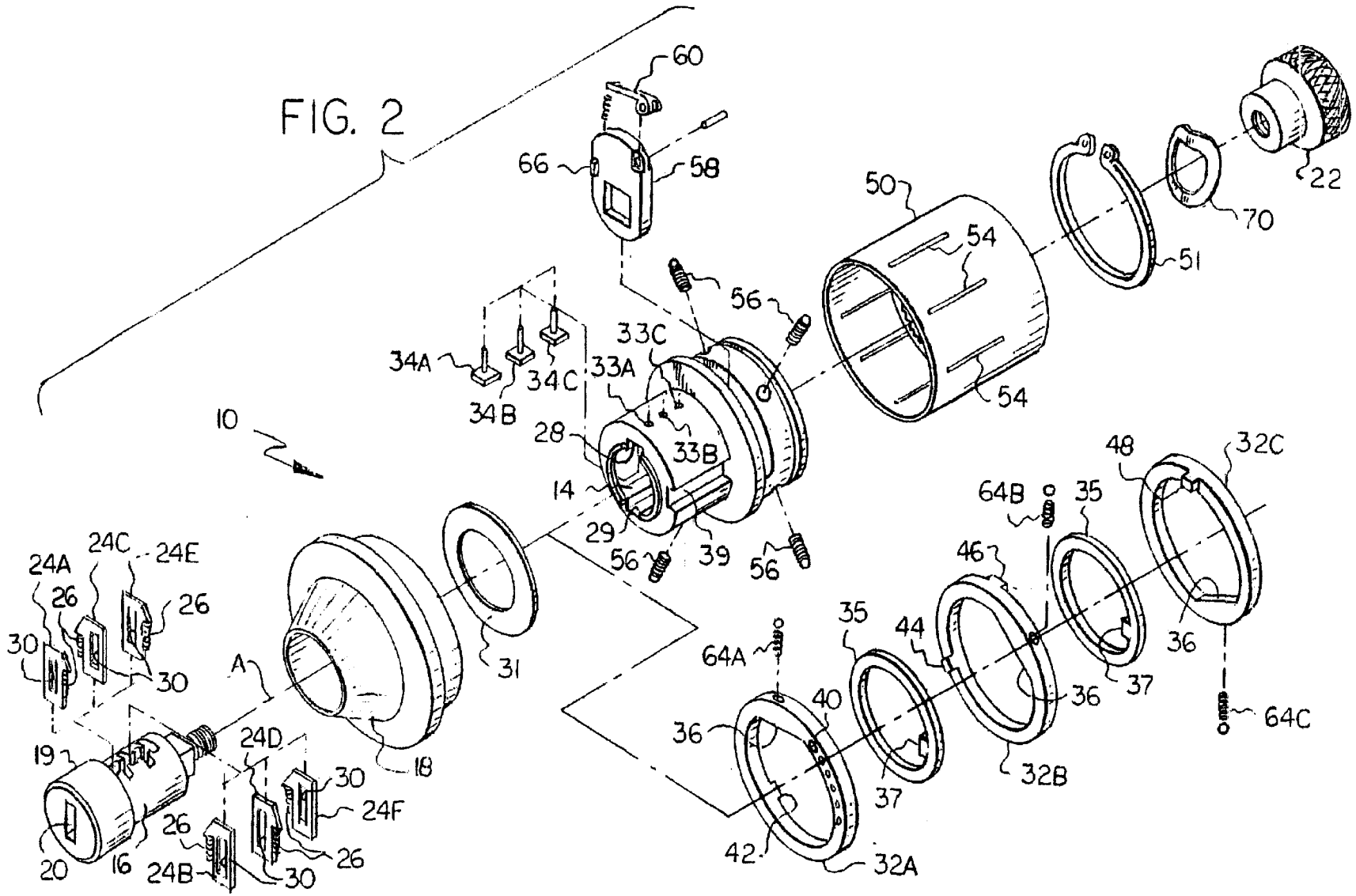
FIG. 2 is an exploded perspective view of the lock apparatus shown in FIG. 1.
Figure 3:
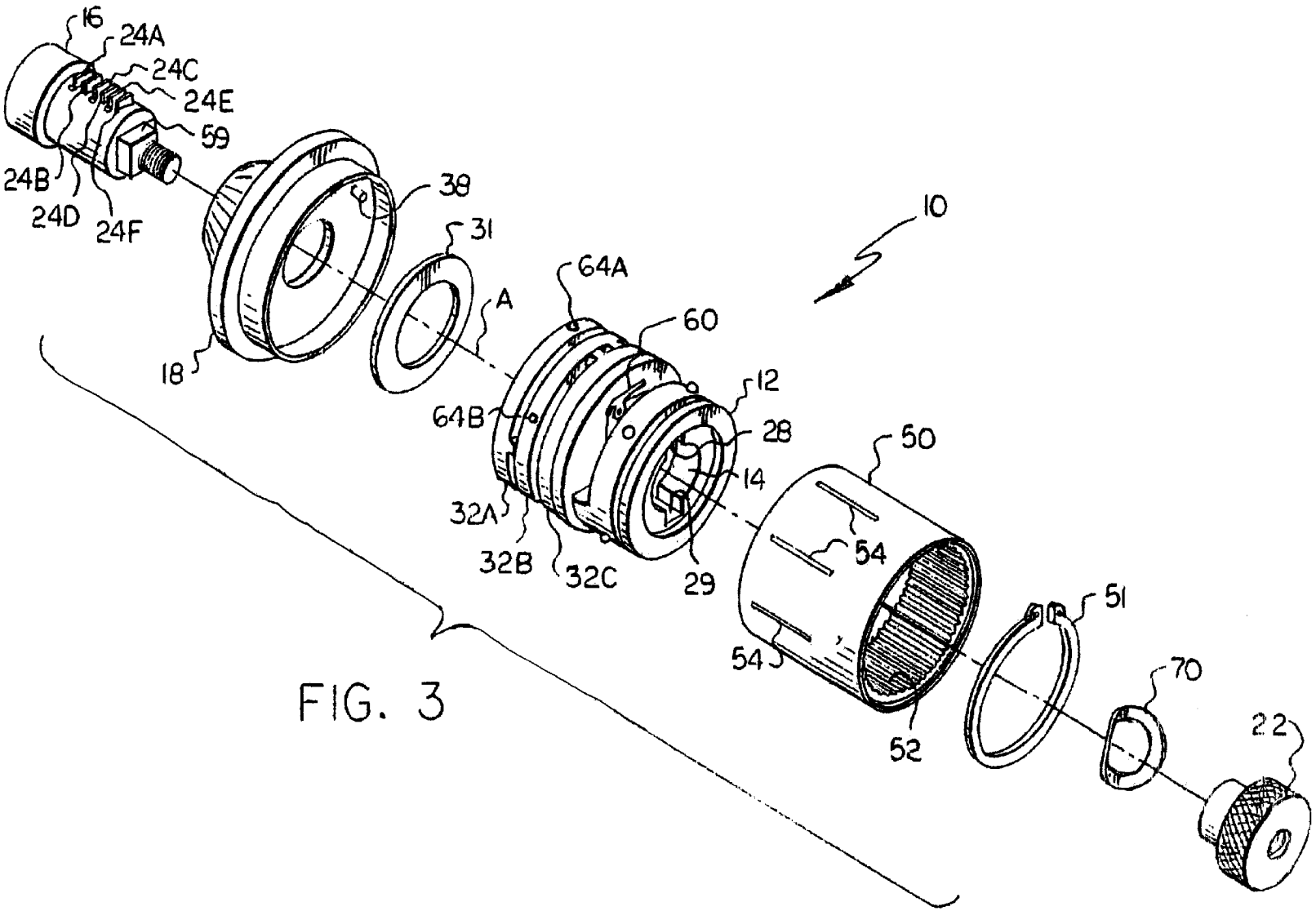
FIG. 3 is an alternate exploded perspective view of the lock apparatus shown in FIG. 1.
Figure 8:
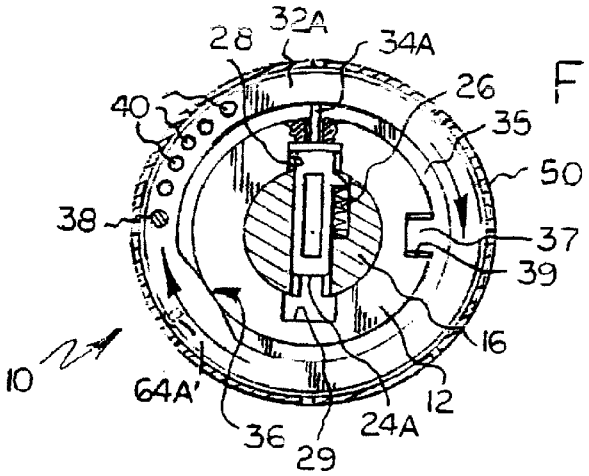
FIG. 8 is a cross-sectional view of the lock apparatus taken generally along the line 8—8 in FIG. 4.

Attention is directed initially to FIGS. 1–3 of the drawings, wherein a lock apparatus formed in accordance with a preferred embodiment of the present invention is shown and designated generally by the reference numeral 10. Lock apparatus 10 comprises a frame 12 having a cylinder bore 14 extending in a direction of axis A through the frame, a cylinder plug 16 partially accommodated by cylinder bore 14 for enabling key operation of the lock apparatus, and a dial 18 mounted coaxially about a front portion of cylinder plug 16 for enabling combination operation of the lock apparatus. A portion of cylinder plug 16 protrudes from dial 18 to form a knob 19 that is preferably knurled or otherwise textured on its external circumferential surface to facilitate manipulation thereof.

Figure 4:
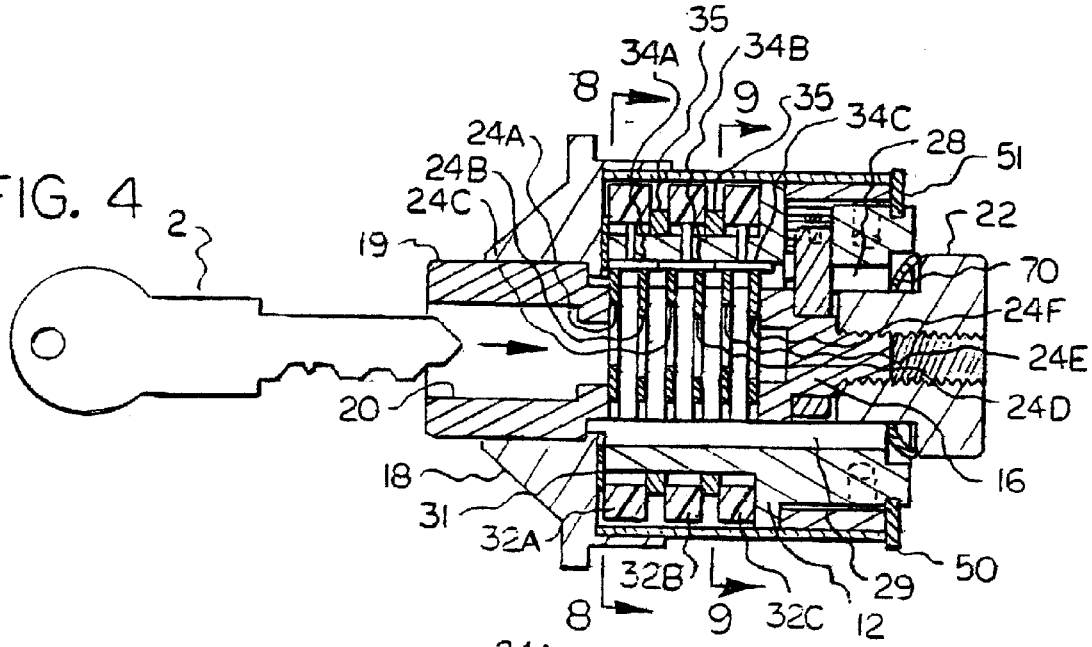
FIG. 4 is a cross-sectional view of the lock apparatus taken generally along the line 4—4 in FIG. 1.
Figure 5:
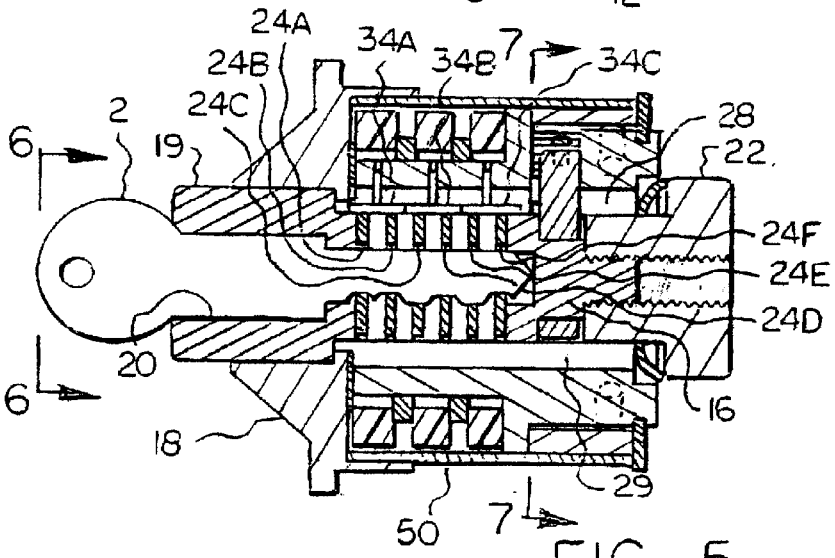
FIG. 5 is a cross-sectional view similar to that of FIG. 4, however showing the insertion of a key into the lock apparatus.

Referring now to FIGS. 4 and 5 in addition to FIGS. 1–3, cylinder plug 16 includes a keyhole 20 opening through knob 19 into which a key 2 is received, and an output nut 22 is threadably or otherwise mated with a rear end of the cylinder plug. Detent means in the form of a plurality of axially spaced wafers 24A–24F is provided for preventing rotation of cylinder plug 16 about axis A relative to frame 12. More specifically, each wafer 24A–24F is slideably held within a respective radial slot in cylinder plug 16 and biased by a spring 26 to engage a primary keyway 28 extending in an axial direction along cylinder bore 14 in frame 12, and each wafer includes an opening 30 for receiving inserted key 2. A secondary keyway 29 is provided opposite primary keyway 28 for temporarily accommodating ends of the wafers 24A–24F as key 2 is inserted progressively through the wafer openings 30. As can be understood, cylinder plug 16 normally resides in a predetermined rotational reference orientation relative to frame 12 when no key is inserted, and is securely kept in the reference orientation by the plurality of wafers 24A–24F engaging primary keyway 28. For example, in the present embodiment, the reference orientation can be thought of as ninety degrees based on the major axis orientation of elongated keyhole 20 of cylinder plug 16 as seen in FIG. 1.

Figure 6:
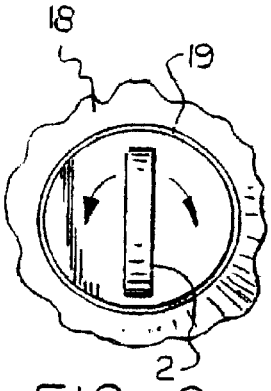
FIG. 6 is a partial front view taken generally along the line 6—6 in FIG. 5.

To operate lock apparatus 10 using key 2, the key is simply inserted until all of the wafers 24A–24F are forced by the key against the urging of springs 26 to withdraw the wafers from within keyways 28 and 29, as shown in FIG. 5. After all the wafers 24A–24F have been withdrawn from keyways 28 and 29, the user can grip the exposed end of key 2 and rotate the key, as shown in FIG. 6, to angularly displace cylinder plug 16 from the reference orientation. Rotational motion of the cylinder plug is imparted to output nut 22, which is connected in a suitable manner to a locking member or bolt acting between the door and the doorframe, such that the locking member is moved to an unlocked position. Re-locking is accomplished by rotating the key and cylinder plug in an opposite angular direction to return the cylinder plug to its reference orientation.

Dial 18 is mounted coaxially about the front end of cylinder plug 16 that protrudes from frame 12, and is independently rotatable about axis A relative to the cylinder plug and frame. Dial 18 is operably connected to detent wafers 24A–24F by way of a plurality of cam rings 32A, 32B, and 32C disposed about frame 12 and a plurality of associated 10 push pins 34A, 34B, and 34C. A washer 31 is situated between dial 18 and first cam ring 32A. The cam rings 32–32C are spaced axially from one another by non-rotating spacers 35 between first cam ring 32A and second cam ring 32B, and between second cam ring 32B and third cam ring 32C, with spacers 35 being prevented from rotating by internal tabs 37 received within an external keyway 39 in frame 12. Each cam ring includes an internal cam surface 36 for engaging an outer end of an associated push pin which is slidably mounted within a respective radially extending guide hole 33A, 33B or 33C through frame 12. An inner end of each push pin 34A–34C is enlarged to bear against two adjacent wafers 24A–24B, 24C–24D, and 24E–24F, respectively. Although the preferred embodiment described herein employs six wafers and three cam rings with three associated push pins each engaging two adjacent wafers, other arrangements are possible wherein the number of total wafers differs, and/or the number of wafers per cam ring and push pin differs. For example, an embodiment having four total wafers, four cam rings, and four push pins would fall under the scope of the present invention.

Dial 18 is connected to rotationally drive first cam ring 32A by a drive pin 38 extending in an axial direction from a rear face of dial 18 for receipt within one of a plurality of angularly spaced drive holes 40 in an opposing front face of first cam ring 32A. First cam ring 32A includes a driver 42 protruding from a rear face thereof for engaging a corresponding follower 44 protruding from a front face of second cam ring 32B. Likewise, second cam ring 32B includes a driver 46 protruding from a rear face thereof for engaging a corresponding follower 48 protruding from a front face of third cam ring 32C.

Figure 9:
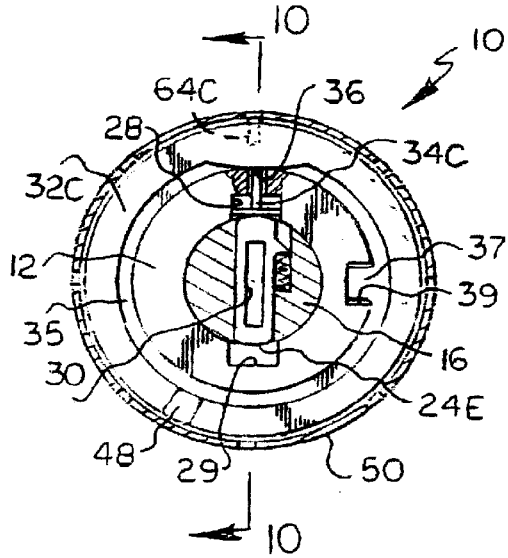
FIG. 9 is a cross-sectional view of the lock apparatus taken generally along the line 9—9 in FIG. 4, however showing operation of a third cam ring of the present invention during combination entry.
Figure 7:
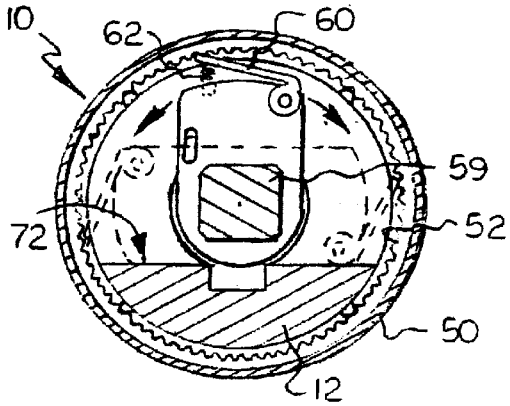
FIG. 7 is a cross-sectional view of the lock apparatus taken generally along the line 7—7 in FIG. 5.
Figure 10:
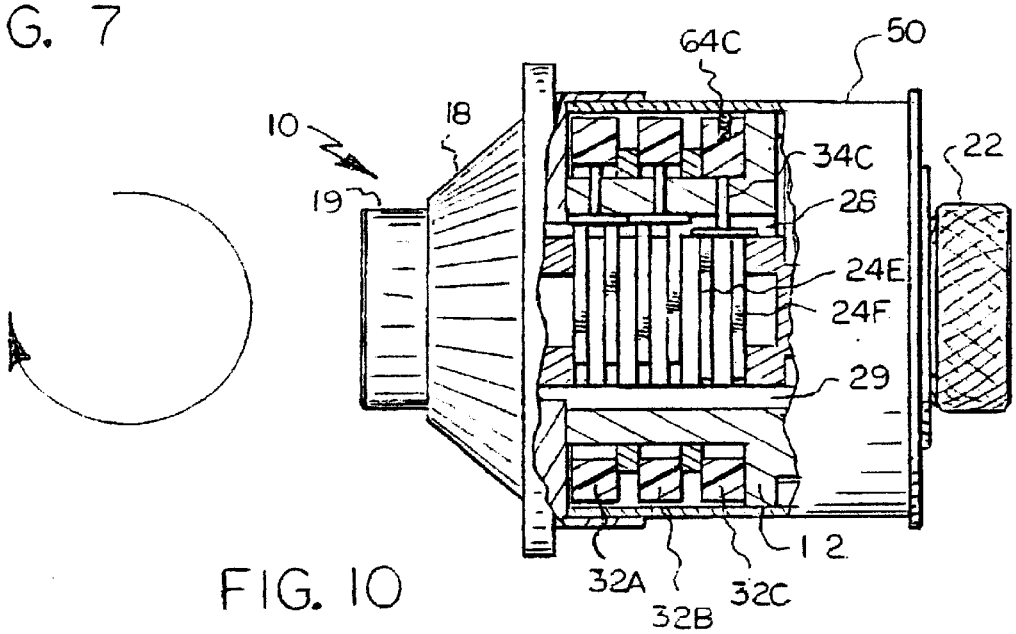
FIG. 10 is a side view of the lock apparatus, partially sectioned generally along the line 10—10 in FIG. 9, showing operation of the third cam ring.

FIGS. 8–13 illustrate operation of lock apparatus 10 by entry of a predetermined combination of numbers using dial 18. Combination entry is performed in a manner commonly known in connection with combination padlocks having a three-number combination. More specifically, dial 18 is rotated at least two complete revolutions in a clockwise direction and stopped when the first number of the combination is aligned with a fixed marker 4 on a doorknob or deadbolt casing (see FIGS. 28 and 30), or with an unmarked location such as a "twelve o'clock" position. During this step, first cam ring 32A is rotationally driven by dial 18 causing successive engagement of driver 42 with follower 44 and driver 46 with follower 48 to transmit rotational motion to third cam ring 32C until cam surface 36 of third cam ring 32C forces push pin 34C downward as shown in FIGS. 9 and 10 to thereby remove wafers 24E and 24F from primary keyway 28. Dial 18 is then rotated in a counter-clockwise direction as indicated in FIG. 11 through one complete revolution and stopped when the second number of the combination is aligned with the fixed marker or location. This step causes driver 42 to come into reverse driving engagement with follower 44 on second cam ring 32B to rotate the second cam ring in a counter-clockwise direction to a position wherein cam surface 36 of second cam ring 32B forces push pin 34B downward as shown in FIG. 11 to thereby remove wafers 24C and 24D from primary keyway 28. The total degree of rotation is insufficient, however, to bring driver 46 into reverse driving engagement with follower 48, thereby allowing third cam ring 32C to remain in its previous orientation. Finally, dial 18 is rotated again in a clockwise direction until the third number of the combination is aligned with the fixed marker or location, thereby rotating first cam ring 32A until its cam surface 36 forces push pin 34A downward as shown in FIG. 12 to remove wafers 24A and 24B from primary keyway 28 without disturbing second cam ring 32B or third cam ring 32C. Once the combination has been entered, all of the detent wafers 24A–24F are removed from engagement with primary keyway 28 and cylinder plug 16 can be rotated about axis A away from its reference orientation with respect to frame 12. Such rotation of cylinder plug 16 can be in either rotational direction as illustrated in FIG. 13, and is accomplished without key 2 by manipulating knob 19.

Lock apparatus 10 preferably comprises a mechanism whereby cam rings 32A–32C are "scrambled" from depressing engagement with associated push pins 34A–32C incident to rotation of cylinder plug 16 back to its reference position when a user locks the door. As will be appreciated from the following portion of the description, cam rings 32–32C are scrambled regardless of whether the preceding unlocking of lock apparatus 10 was by key or by combination. Additional reference is now made to FIGS. 14–21 for describing the scrambling mechanism. Lock apparatus 10 comprises a cam tube 50 arranged coaxially about cam rings 32–32C, frame 12, and cylinder plug 16. Cam tube 50 is secured by a snap ring 51 fitting within an annular groove in frame 12 to prevent axially directed movement of the cam tube relative to the frame. Cam tube 50 is provided with an internal toothed portion 52 adjacent its rear end, and a plurality of axially elongated slots 54 angularly spaced about cam tube 50 forward of internal toothed portion 52. A plurality of spring plungers 56 is mounted at angularly spaced intervals about frame 12 to engage toothed portion 52, thereby introducing suitable resistance to rotation of cam tube 50 relative to frame 12. A carrier 58 has a proximal end mounted on a square cross-section portion 59 of cylinder plug 16 and a distal end which supports an elastically deformable ratchet arm 60 such that the carrier and ratchet arm rotate together with the cylinder plug about axis A. Ratchet arm 60 is fixed at one end thereof to the distal end of carrier 58, and has a free end biased by a spring 62 for operative engagement with teeth 53 of internal toothed portion 52 of cam tube 50. Depending upon the elastic deformation qualities of ratchet arm 60, spring 62 may not be necessary.

Figure 14:
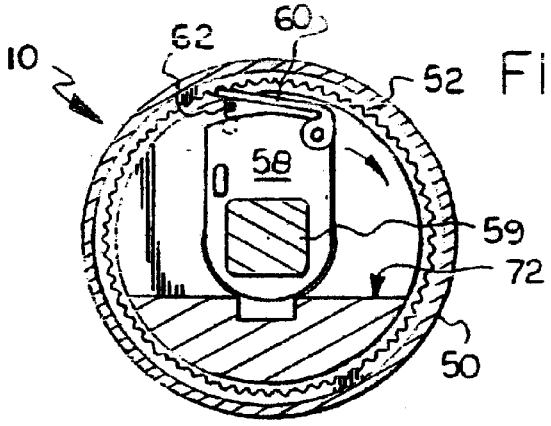
FIG. 14 is a cross-sectional view of the lock apparatus taken generally along the line 14—14 in FIG. 12.
Figure 15:
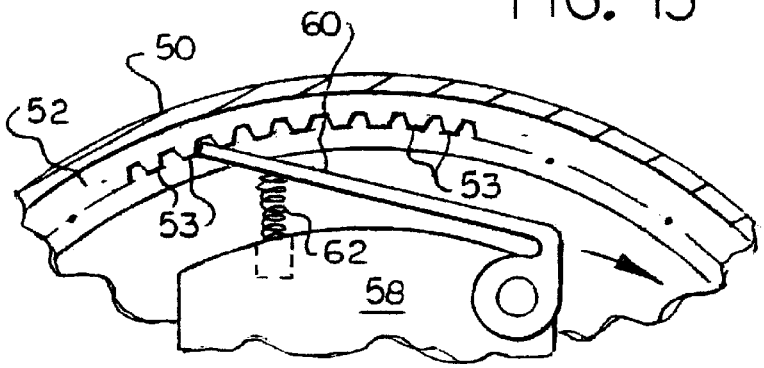
FIGS. 15–17 are a series of enlarged cross-sectional views showing operation of a ratchet of the present invention.
Figure 16:
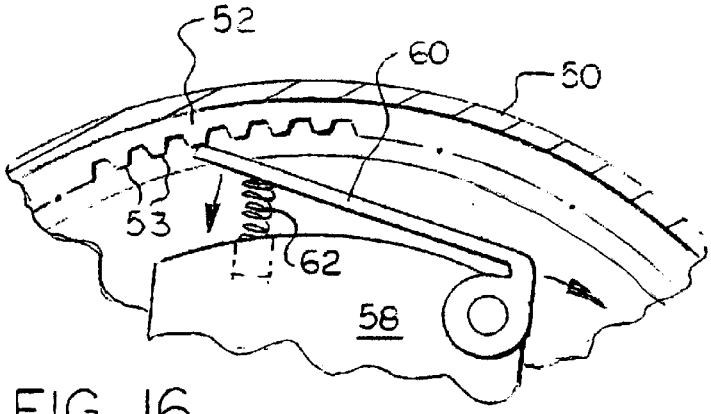
Figure 17:
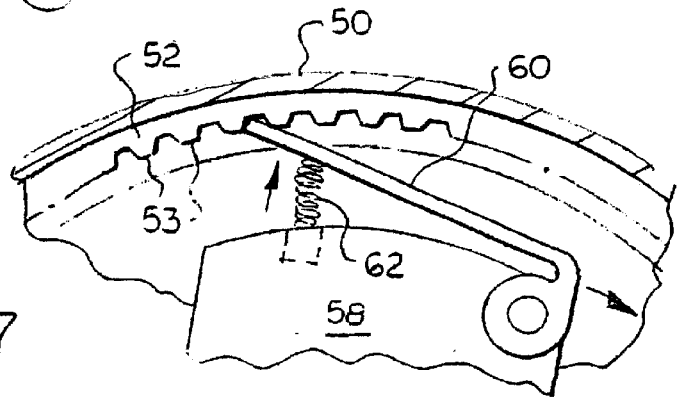
Figure 18:
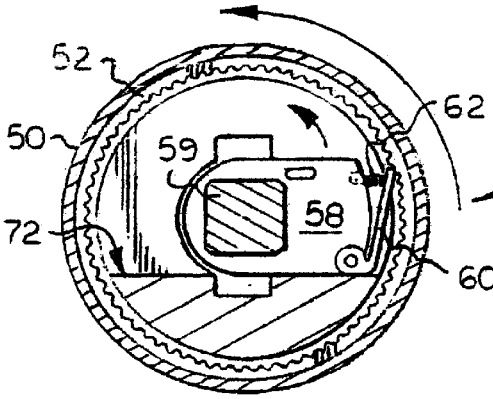
FIG. 18 is a view similar to that of FIG. 14, however showing a cylinder plug and ratchet arm carrier of the present invention rotated 90 degrees in a clockwise direction from a reference orientation.
Figure 19:
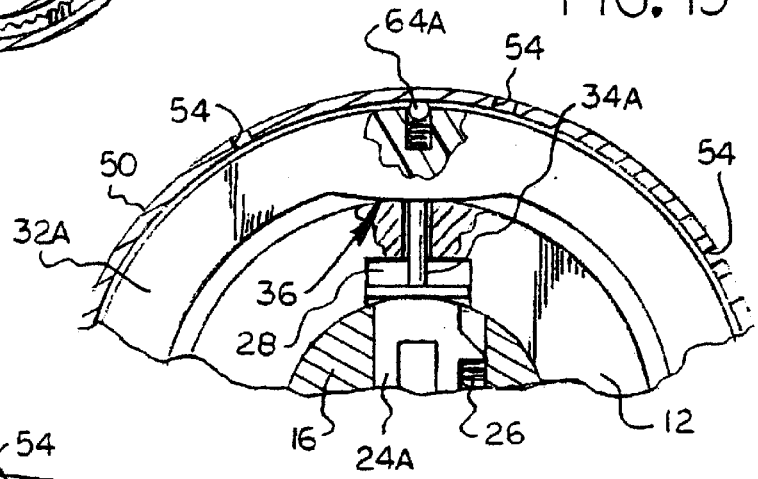
FIG. 19 is an enlarged cross-sectional view taken generally along the line 19—19 in FIG. 12.
Figure 20:
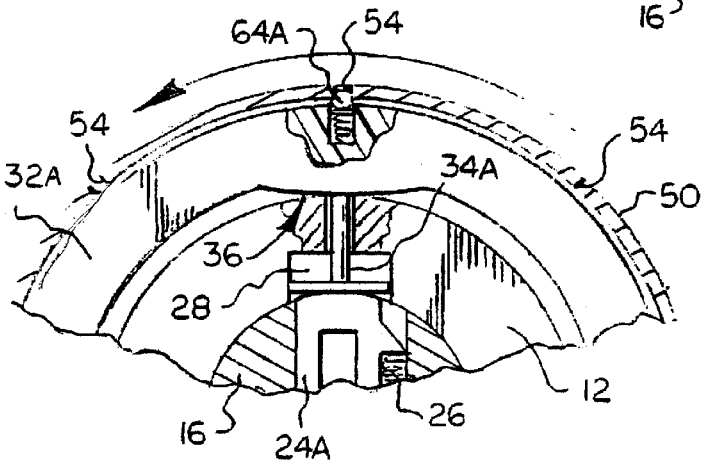
FIGS. 20 and 21 are a series of enlarged cross-sectional views similar to the view of FIG. 19, however showing rotation of a cam tube of the present invention.
Figure 21:
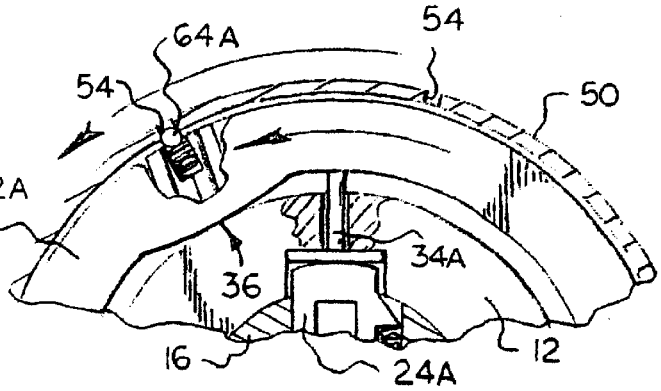

It will be recalled that when a user unlocks and then re-locks a door by operating lock apparatus 10, the user rotates cylinder plug 16 in one angular direction to unlock the door and then in an opposite angular direction to re-lock the door. For example, the user can rotate cylinder plug 16 in a clockwise direction as shown in FIG. 14 to unlock the door, and then in a counter-clockwise direction as shown in FIG. 18 to re-lock the door. During clockwise rotation of cylinder plug 16, the free end of ratchet arm 60 is forced against the urging of spring 62 toward carrier 58 as it moves over each tooth 53, and the cam tube 50 remains rotationally fixed relative to frame 12 by virtue of spring plungers 56, as illustrated in FIGS. 15–17. Conversely, during counter-clockwise rotation of cylinder plug 16, the free end of ratchet arm 60 engages a tooth 53 at an angle favorable to imparting sufficient torque to cam tube 50 to overcome the rotational resistance offered by spring plungers 56 such that the cam tube rotates together with the cylinder plug, carrier, and ratchet arm. As cam tube 50 rotates in the counter-clockwise direction in accordance with FIGS. 19–21, one of the plurality of slots 54 on the cam tube will become aligned with a plurality of spring plungers 64A–64C respectively located on the exterior of cam rings 32–32C opposite cam surface 36. Spring plungers 64A–64C are thus forced into engagement with the aligned slot 54, and as a consequence cam rings 32A–32C are rotated together with cam tube 50, ratchet arm 60, carrier 58, and cylinder plug 16 until the cylinder plug is returned to its reference orientation. Ratchet arm 60 may of course be arranged in an opposite manner such that cam tube 50 and cam rings 32–32C rotate clockwise with clockwise rotation of the cylinder plug. It will be appreciated that the cam rings are scrambled either as the user unlocks the door or as the user re-locks the door, depending upon the arrangement of ratchet arm 60 and the initial direction of rotation as the door is unlocked. It is also noted that elongated slots 54 are preferred recesses for receiving ball plungers 64A–64C due to ease of manufacturing and thickness limitations in cam tube 50, however such recesses could be in the form of individual through-holes for the respective ball plungers, individual non-through recesses in the internal wall of cam tube 50, or non-through elongated recesses in the internal wall of cam tube 50.

Another feature preferably incorporated into lock apparatus 10 enables the dial combination to be changed as desired. As seen in FIG. 22, dial 18 includes drive pin 38 extending in a rearward direction from the dial and received within one of a plurality of angularly spaced drive holes 40 provided in the front face of first cam ring 32A. Depending upon which of the plurality of holes 40 receives drive pin 38, a specific driving orientation is established between dial 18 and first cam ring 32A which determines the combination numbers. Thus, to change the combination, dial 18 must be separated in an axial direction from first cam ring 32A to withdraw drive pin 38 from within a drive hole 40, dial 18 must be rotated relative to first cam ring 32A, and then dial 18 and first cam ring 32A must be moved together in an axial direction to insert drive pin 38 within a new drive hole 40, thereby establishing a new drive orientation and a new combination. FIGS. 23–26 illustrate the structure and procedural steps in connection with changing the combination. As can be seen in FIG. 24, a front side of carrier 58 includes a protrusion 66, and frame 12 includes a recess 68 in an annular face thereof opposite the front side of the carrier. Normally, protrusion 66 does not reside within recess 68 because carrier arm is not in a rotational position wherein the protrusion is aligned with the recess, and because a spring washer 70 mounted between frame 12 and output nut 22 urges output nut 22, carrier 58, cylinder plug 16, and dial 18 axially to the right in FIG. 24 relative to frame 12. The location of recess 68 is chosen such that cylinder plug 16 must be moved away from its reference orientation to bring protrusion 66 into alignment with recess 68. In the embodiment presently described, cylinder plug 16 is rotated counter-clockwise until further rotation is prevented by engagement of carrier 58 with a horizontal surface 72 of frame 12, approximately ninety degrees from the reference orientation as shown in FIG. 23, to bring protrusion 66 into alignment with recess 68. Once alignment is achieved, the user is able to pull dial 18, cylinder plug 16, carrier 58, and output nut 22 in an axial direction against the urging of spring washer 70 to the left as shown in FIG. 25 just enough to withdraw drive pin 38 from an existing drive hole 40, thereby separating the driving connection between dial 18 and first cam ring 32A. Dial 18 is then rotated relative to first cam ring 32A to align drive pin 38 with a new drive hole 40, and dial 18 is released. FIG. 26 shows dial 18, cylinder plug 16, carrier 58, and output nut 22 being forced to the right by spring washer 70 upon completion of the combination change. It will be appreciated that the combination may only be changed by a person having either the key or knowledge of the combination. From a structural standpoint, the male/female mating between drive pin 38 and drive hole 40 may be reversed such that drive holes 40 are located on dial 18 and drive pin 38 is located on first cam ring 32A. Likewise, protrusion 66 can be formed on frame 12 and recess 68 can be provided in carrier 58 to achieve the desired function. It is noted that knob 19 of cylinder plug 16 bears against a lip on frame 12 to provide an annular gap for an inner portion of dial 18 so that the dial is not pinched between the knob and frame by force from spring washer 70.

FIGS. 27 and 28 show a manner of mounting lock apparatus 10 within a standard door knob 80 using spring clips 82. A drive shaft 84 is connected to output nut 22 for transmitting rotational motion to a locking member or mechanism (not shown). FIGS. 29 and 30 show a manner of mounting lock apparatus 10 within a standard deadbolt casing 90 using fasteners 92. A drive member 94 is connected to output nut 22 for transmitting rotational motion to a locking member or mechanism (not shown). Accordingly, the lock apparatus of the present invention is easily adapted for retrofit with an existing doorknob or deadbolt. Of course, the lock apparatus of the present invention can also be provided as part of a newly manufactured doorknob, deadbolt, locker door, desk drawer, file cabinet drawer, or other lock mechanism.

What is claimed is:

1. A lock apparatus comprising:

a frame;

an output nut;

a cylinder plug mounted at least partially within said frame for rotation about an axis from a rotational reference orientation relative to said frame, said cylinder plug being operably connected to said output nut;

a dial rotatable about said axis relative to said cylinder plug;

detent means movable between an engaged position for preventing rotation of said cylinder plug from said reference orientation and a released position for enabling rotation of said cylinder plug from said reference orientation;

said detent means being moved from said engaged position to said released position by insertion of a key within said cylinder plug; and said detent means being moved from said engaged position to said released position by entry of a predetermined combination using said dial;

whereby said lock apparatus can be operated either by inserting said key into said cylinder plug or by entering said combination using said dial.

2. The lock apparatus according to claim 1, wherein said cylinder plug includes a knob portion for rotating said cylinder plug without said key.

3. The lock apparatus according to claim 1, wherein said detent means includes a plurality of wafers spaced in an axial direction along said cylinder plug for movement between a radially flush condition and a radially projecting condition and said frame includes an internal keyway, said plurality of wafers being biased toward said radially projecting condition to engage said internal keyway to prevent rotation of said cylinder plug from said reference orientation, and said plurality of wafers being held in said radially flush condition by said frame once said cylinder plug is rotated from said reference orientation.

4. The lock apparatus according to claim 3, wherein said plurality of wafers is connected to said dial by a plurality of slidable push pins extending radially through said frame to act on said plurality of wafers, and a plurality of cam rings are operably coupled to said dial and arranged about said frame to depress said plurality of push pins to force said plurality of wafers into said radially flush condition when said combination is entered.

5. The lock apparatus according to claim 4, wherein each of said plurality of push pins acts on more than one of said plurality of wafers.

6. The lock apparatus according to claim 4, further comprising:

a ratchet arm mounted on said cylinder plug for rotation therewith;

a cam tube arranged about said plurality of cam rings and said ratchet arm, said cam tube having an internal toothed portion cooperating with said ratchet arm such that said cam tube rotates with said cylinder plug in a first rotational direction but does not rotate with said cylinder plug in a second rotational direction opposite said first rotational direction, and said cam tube having a plurality of recesses;

a plurality of plungers carried one by each of said cam rings, each of said plurality of plungers being biased for engagement with one of said plurality of recesses upon alignment therewith to cause said plurality of cam rings to rotate with said cam tube and said cylinder plug in said first rotational direction;

whereby said plurality of cam rings is rotated away from depressing engagement with said plurality of push pins when said cylinder plug is rotated in said first rotational direction during operation of said lock apparatus.

7. The lock apparatus according to claim 6, wherein said plurality of recesses comprises a plurality of axially elongated slots angularly spaced about said cam tube.

8. The lock apparatus according to claim 4, wherein said plurality of cam rings comprises a first cam ring rotatably driven by said dial and operably connected to at least one other cam ring of said plurality of cam rings.

9. The lock apparatus according to claim 8, wherein a rotational driving orientation between said dial and said first cam ring is adjustable for changing said combination.

10. The lock apparatus according to claim 9, further comprising biasing means for maintaining said dial in driving engagement with said first cam ring, said dial being movable against the urging of said biasing means to disengage said dial from driving engagement with said first cam ring to permit adjustment of said rotational driving orientation between said dial and said first cam ring.

11. The lock apparatus according to claim 10, wherein said dial is mounted on said cylinder plug, said output nut is attached to said cylinder plug, and said biasing means comprises a spring acting between said output nut and said frame.

12. A lock apparatus comprising:

a dial for entering a combination of numbers by sequenced rotations of said dial;

a plurality of cam rings for unlocking said lock apparatus when said predetermined combination of numbers is entered, said plurality of cam rings including a first cam ring having a plurality of angularly spaced drive holes facing said dial;

a drive pin extending from said dial and received within one of said plurality of drive holes to rotatably couple said first cam ring with said dial at a chosen drive orientation that determines said combination; and biasing means for urging said dial and first cam ring axially together to maintain said rotational coupling;

said dial being axially separable from said first cam ring against the urging of said biasing means when said lock apparatus is unlocked to permit relative rotation between said dial and said first cam ring;

whereby said drive orientation can be changed by causing said drive pin to be received within a different one of said plurality of drive holes to change said combination.

13. A lock apparatus comprising:

a dial for entering a combination of numbers by sequenced rotations of said dial, said dial having a plurality of angularly spaced drive holes;

a plurality of cam rings for unlocking said lock apparatus when said predetermined combination of numbers is entered, said plurality of cam rings including a first cam ring having a drive pin extending therefrom and received within one of said plurality of drive holes to rotatably couple said first cam ring with said dial at a chosen drive orientation that determines said combination; and biasing means for urging said dial and first cam ring axially together to maintain said rotational coupling;

said dial being axially separable from said first cam ring against the urging of said biasing means when said lock apparatus is unlocked to permit relative rotation between said dial and said first cam ring;

whereby said drive orientation can be changed by causing said drive pin to be received within a different one of said plurality of drive holes to change said combination.

* * * * *